United States Patent [19]

Arnold

[11] Patent Number: 4,887,538

[45] Date of Patent: Dec. 19, 1989

[54] MODULAR OFFICE FURNITURE SYSTEM

[75] Inventor: William D. Arnold, St. Louis, Mo.

[73] Assignee: Lee-Rowan Company, St. Louis, Mo.

[21] Appl. No.: 256,452

[22] Filed: Oct. 12, 1988

[51] Int. Cl.[4] ..... A47B 3/00

[52] U.S. Cl. ..... 108/111; 312/195; 211/182

[58] Field of Search ..... 108/111, 114, 64, 153, 108/157, 90; 312/195, 184, 257 SK, 330, 140.3; 211/126, 182, 189, 181

[56] References Cited

U.S. PATENT DOCUMENTS

| | | | |
|---|---|---|---|
| 1,508,259 | 9/1924 | Stafford | 312/195 |
| 2,585,360 | 2/1952 | Williams | 211/182 X |
| 2,623,527 | 12/1952 | Guichard | 211/126 |
| 3,267,889 | 8/1966 | Bedol | 108/157 |
| 4,067,656 | 1/1978 | Dennis | 211/182 X |
| 4,158,335 | 6/1979 | Belcastro, deceased et al. | 108/64 |
| 4,176,753 | 12/1979 | Godfrey | 211/182 |

FOREIGN PATENT DOCUMENTS

| | | | |
|---|---|---|---|
| 1208660 | 2/1960 | France | 108/153 |

*Primary Examiner*—Joseph Falk
*Assistant Examiner*—José V. Chen
*Attorney, Agent, or Firm*—Rogers, Howell & Haferkamp

[57] ABSTRACT

An office system comprising a desk and a file folder and basket frame. Each comprises a group of tubular components, file folder frames and baskets, some of which can be used for either the desk or the file holder frame and basket. Assembly is easy using household tools. A stop can be snapped in place to limit sliding movement of either or both the file holder frame or the basket.

6 Claims, 3 Drawing Sheets

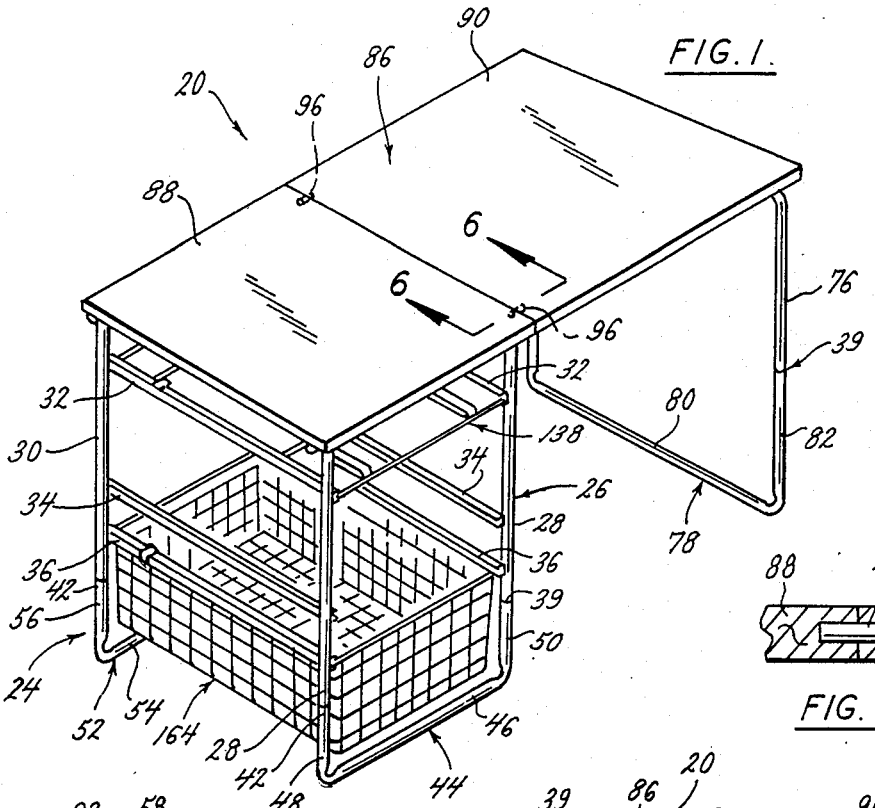
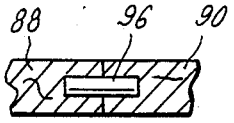
FIG. 6.
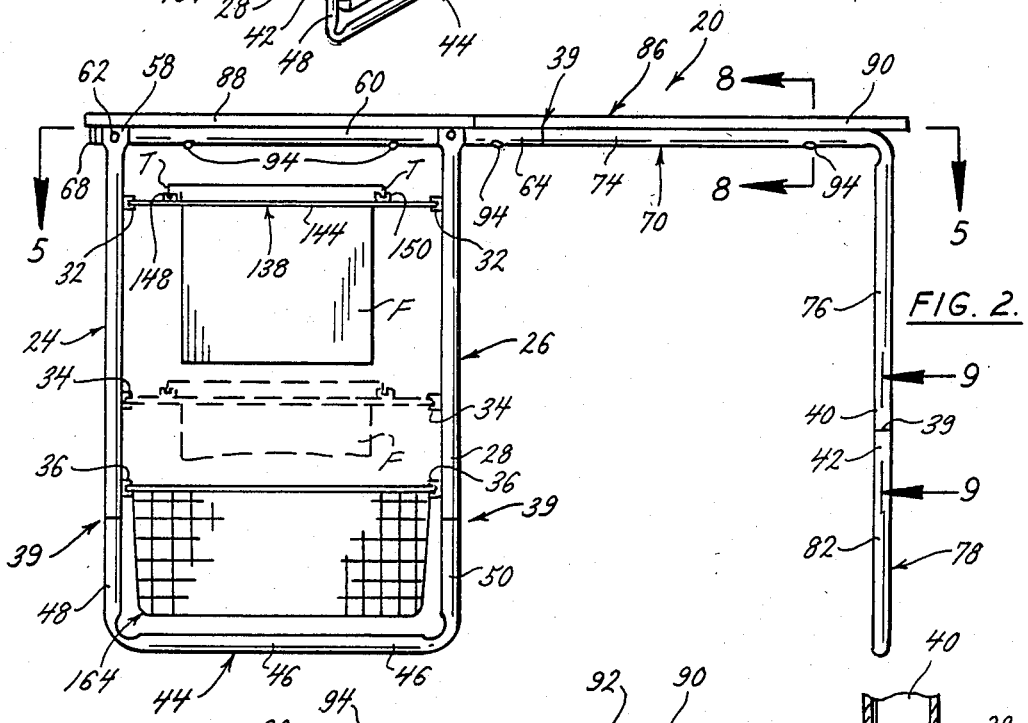
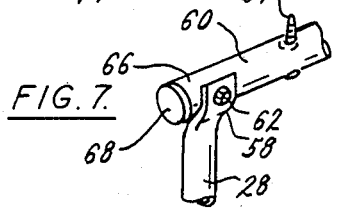
FIG. 7.
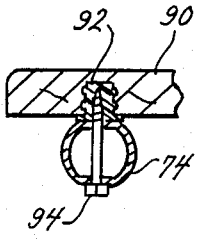
FIG. 8.
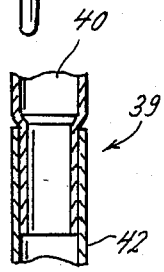
FIG. 9.

MODULAR OFFICE FURNITURE SYSTEM

BACKGROUND OF THE INVENTION:

This invention relates to an office system comprising easy to assemble components for forming selected office furniture that is very inexpensive and is attractive in appearance.

Office furniture for high volume production and sale is limited in marketability because of the high cost of production, the high cost of shipping and warehousing bulky merchandise, and the unattractive appearance of the furniture. The present invention solves the cost problem by providing office furniture made from only a few components that can be manufactured inexpensively and that can be compactly packaged so that the cost of transportation and storage is minimized. The invention further attacks the cost problem by providing an office system that can be sold in packaged components and yet can easily be installed with household tools by an unskilled purchaser.

Further, this office system resolves the appearance objection by providing an office system having an intentional open look that is designed for an appealing appearance.

SUMMARY OF THE INVENTION:

This office system comprises a desk and a file folder and basket assembly, both of which can use the same file folder frame and basket and both of which can be shipped and sold in compact packages of unassembled components and can be installed easily and quickly.

The desk comprises side assemblies of tubes and channel runners that can be telescopingly fitted into bottom cross tubes. A pair of top tubes can be fastened to the side assemblies. These are joined to curved support tubes that in turn are press-fitted into bottom cross tubes. The top of the desk consists of two sections located together by dowels and connected to the frame by simple screws that thread into fittings installed in the top sections.

The file folder and basket frame comprises tube sections that are press-fitted together. Only six components are required to form the frame and they can be assembled without the use of tools. Both the desk and file folder and basket assembly can selectively incorporate a file folder frame or a basket, or both. Both are designed to fit between opposed parallel channel runners. A special stop snaps onto one or both runners to provide a stop against inadvertent removal of either the file folder frame or the basket.

DESCRIPTION OF THE DRAWINGS:

FIG. 1 is a perspective view of a desk which is one of the components of the office system of this invention;

FIG. 2 is an enlarged front elevation view of the desk of FIG. 1 illustrating alternative basket and file folder storage;

FIG. 6 is an enlarged view in section taken along the plane of the line 6—6 of FIG. 1;

FIG. 7 is an enlarged partial view of the connection between components of the office system;

FIG. 8 is an enlarged view in section taken along the plane of the line 8—8 of FIG. 2;

FIG. 9 is an enlarged view in section taken along the plane of the line 9—9 of FIG. 2;

Figure 3:
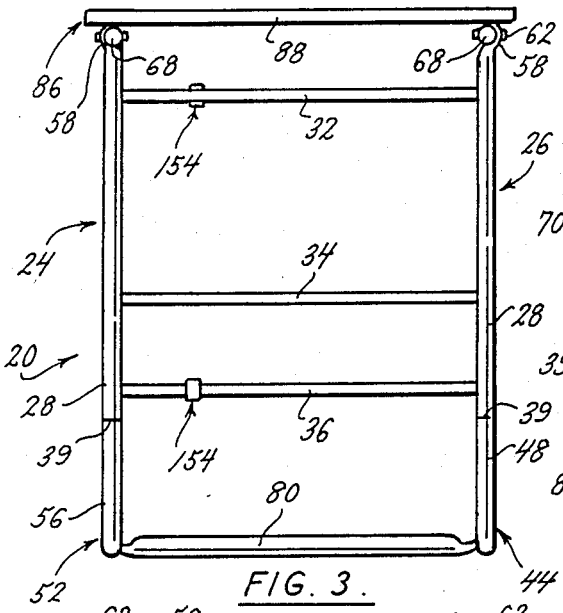
FIG. 3 is an end elevation view of the desk as viewed from the left side of FIG. 2.
Figure 4:
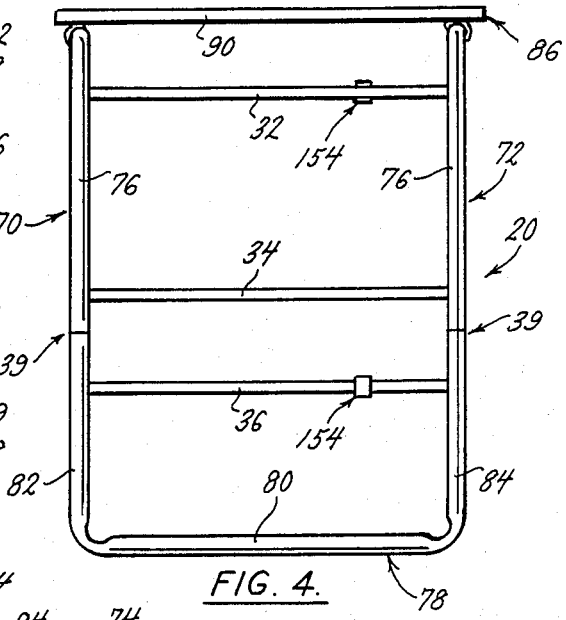
FIG. 4 is a right end view of the desk as viewed from the right side of FIG. 2.
Figure 5:
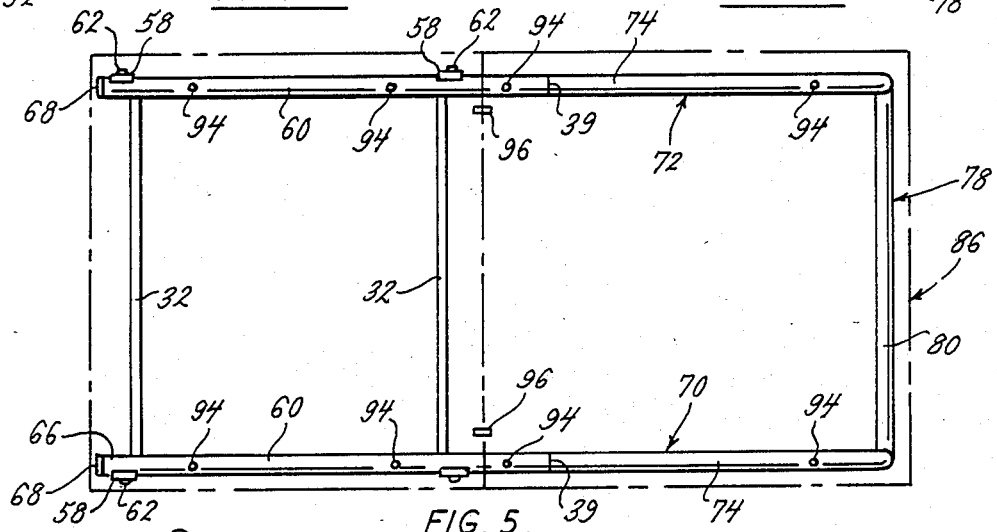
FIG. 5 is a top plan view as viewed along the plane of the line 5—5 of FIG. 2.

DETAILED DESCRIPTION OF PREFERRED EMBODIMENT:

This office system incorporates inexpensive components easily assembled by a purchaser to create sturdy, open office components such as a desk 20 and a file folder and basket assembly 22.

Referring first to the desk 20, it includes two side sections 24 and 26 that are identical. Each side sections 24 and 26 is formed of two vertical tubes 28 and 30 between which three channel runners 32, 34 and 36 extend and are welded at their ends. Thus, the channel runners 32, 34 and 36, and the tubular members 28 and 30 constitute a flat side section 24 or 26 that can be packaged flat.

The sectional view of FIG. 9 is representative of a joint 39 formed by cooperating tube ends 40 and 42 that can be telescoped together in a press-fit when it is desired to join two tubes together as is known in the art. Employing such a joint connection 39, the tubular members 28 of the side assemblies 24 and 26 are fitted at their bottom ends to a cross tube 44 that has a lower base section 46 and upstanding leg sections 48 and 50. Likewise, the tube members 30 of the side sections 24 and 26 are fitted to a cross tube 52 that has a lower base section 54 and upstanding leg sections 56 into which the tubes 30 are fitted to form joints 39. When thus fitted together, the cross tubes 44 and 52 provide a stable base and support the side sections 24 and 26 in their proper positions.

As shown in FIG. 7, the upper end 58 of each tube section 28 and 30 of the side sections 24 and 26 is flattened and curved so that it will fit against the side of a top straight tube 60. When fastened by suitable screws 62, one straight tube 60 connects the tops of the tubes 28 and the other straight tube 60 connects and extends between the tops of the tubes 30. For both of the tubes 60, ends 64 extend in a common direction. The short ends 66 of the tubes 60 are closed by plastic plugs 68.

There are front and rear curved support tubes 70 and 72, each of which has a horizontal leg 74 and a vertical leg 76. The horizontal legs 74 are joined to the long ends 64 of the top straight tubes 60 at a telescoping joint 39. A cross tube 78 has a base section 80 and upstanding legs 82 and 84. The legs 82 and 84 are fitted to the vertical sections 76 of the curved support tubes 70 and 72 by the kinds of joints 39 illustrated in FIG. 9.

A top 86 consists of two laminated rectangular sections 88 and 90. At various locations, the laminated sections 88 and 90 have screw fittings 92. The top section 88 is fastened in place by screws 94 that extend through the top straight tubes 60 and are threaded into the screw fittings 92. There are location dowels 96 pressed into appropriate openings in the end of the top section 88. The other top section 90 is aligned with and pressed onto the dowels 96 and it is connected to the long ends 64 and the curved support tubes 70 and 72 by screws 94 threaded into screw fittings 92. These connections are illustrated in detail in FIG. 2.

Turning to the file folder and basket storage assembly 22, there are two cross tubes 100 and 102 that may be identical to the cross tubes 44 and 52. Thus, each cross tube 100 and 102 has a lower horizontal base tube 104 and upstanding legs 106 and 108. Two upright assemblies 110 and 112 each include spaced parallel tubes 114 and 116. There are two channel runners 118 and 120 extending between and welded to the vertical tubes 114 and 116. The channel runners 118 and 120 face inwardly as is clearly shown in FIG. 13.

The vertical tubes 114 and 116 fit in the vertical leg members 106 at joints 39 like the one illustrated in FIG. 9. Similarly, the vertical tubes 114 and 116 fit into the vertical legs 108 at joints 39.

There are front and rear cross tubes 122 and 124. Each cross tube 122 and 124 includes a top horizontal section 126 and vertical side legs 128 and 130. A channel runner 132 extends between, and its ends are welded to, the side legs 128. Another channel runner 134 extends between, and its ends are welded to, the legs 130. The legs 128 fit on the vertical tubes 114 and 116 in joints 39 and the legs 130 fit on the opposite vertical tubes 114 and 116 at joints 39.

Figure 10:
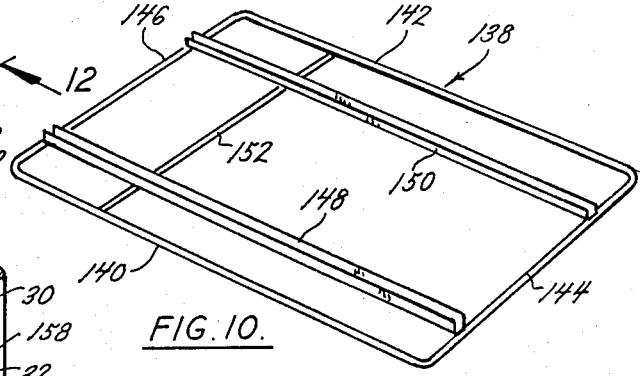
FIG. 10 is a perspective view of a file folder support.

FIG. 10 illustrates a file holder frame 138 that can be used with either the desk 20 or the file and basket frame 22. The file holder frame 138 is formed of a rectangular wire member having parallel sides 140 and 142 joined to front and rear ends 144 and 146. A pair of channel runners 148 and 150 extend longitudinally between, and their ends are welded to, the front and rear wire sections 144 and 146. The channel runners 148 and 150 open upwardly and they are spaced apart by the width of the span between the side tabs T of a standard file folder F (see FIG. 14). A cross member 152 that functions as a contact element extends transversely between the side wires 140 and 142 toward the back wire 146.

On the desk 20, the channel runners 32 can function as a pair of file support runners and the channel runners 34 can function as another pair of file support runners. On the file folder and basket frame assembly 22, the channel runners 132 and 134 can function as a pair of file frame runners and the channel runners 118 can function as another pair of file frame runners.

Figure 11:
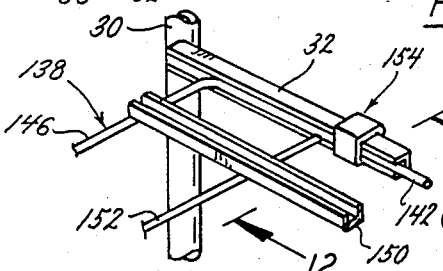
FIG. 11 is an enlarged partial perspective view of the installation of the file folder support.
Figure 12:
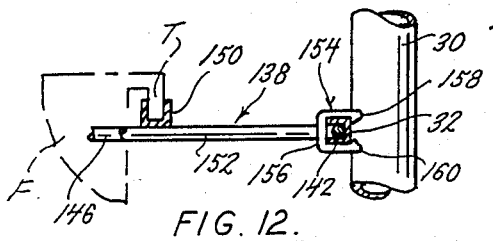
FIG. 12 is a further enlarged view taken along the plane of the line 12—12 of FIG. 11.

For each file folder frame 138, there are two stops 154 (see FIG. 11). The stops will slide freely along a channel runner, such as the channel runner 32, once the stop 154 is snapped in place. When used with the file holder frame 138, the stop 154 is installed from the inside out with its back wall 156 overlying the side wire 142 within the channel runner 32 and with front detents 158 snapped over the back of the channel runner 32 (see FIG. 12). This puts the detents 158 and 160 in front of each stop 154 in the path of a front tube 28 (on the desk) or 114 (on the file folder and basket frame).

If desired, a basket 164 can be used with either the desk 20 or the file folder and basket frame 22. The basket 164 is formed with an upper peripheral wire having side sections 166 and front and rear sections 168 and 170, respectively. A plurality of vertical wires 172 extend downwardly from the side sections 166 and across the bottom of the basket 164, and a plurality of horizontal wires 174 are joined to the vertical wires. Similar vertical and horizontal wires 176 and 178 extend between the front and rear wire sections 168 and 170 and across the bottom of the basket 164.

Figures 13, 14, 15:
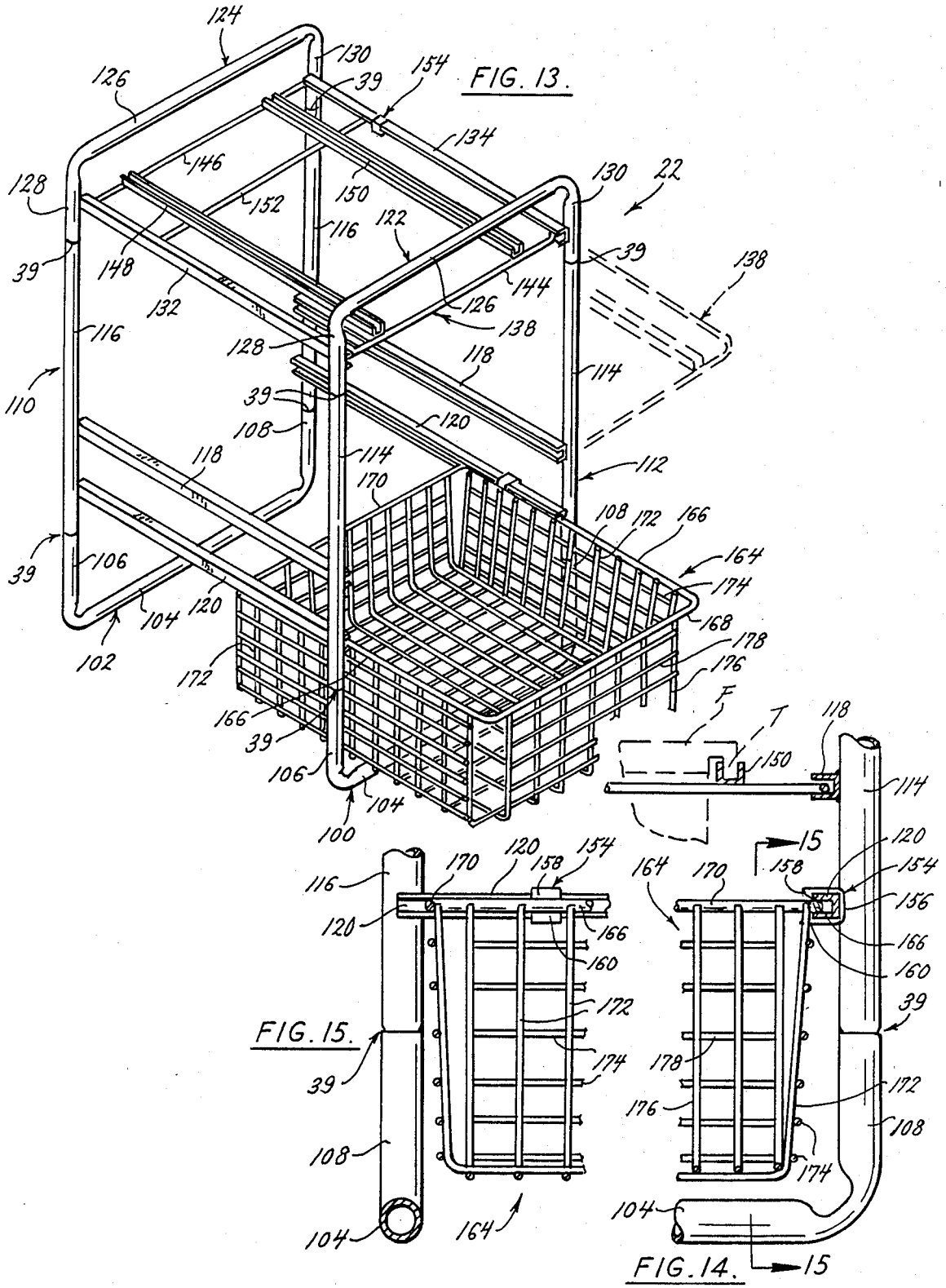
FIG. 13 is a perspective view of free-standing file folder and basket support assembly incorporating components of this office system.
FIG. 14 is an enlarged front elevation view of the lower right-hand portion of FIG. 13.
FIG. 15 is a view in section taken along the plane of the line 15—15 of FIG. 14.

The basket 164 can fit between any of the opposed channel runners, but in particular, the channel runners 36 on the desk 20 and the channel runners 120 on the file folder and basket frame 22 are particularly provided to accommodate the basket, as shown in FIGS. 1 and 13. The side wires 166 of the basket 164 slide within the channel runners 36 (or 120). The stop 154 is snapped onto a channel runner, such as the channel runner 120 (FIG. 14), and the detents 158 and 160 snap over the inner edges of the channel runner 120. This locates one detent 160 between a selected pair of the vertical wires 172, selected to function as contact elements, and positions the back 156 of the stop 154 in the path of a front tube 114.

OPERATION AND USE

This office system, including the components for the desk 20 and for the file folder and basket assembly 22, can be sold disassembled and packed and shipped in compact cartons. The entire system can easily be installed with the use of a screw driver and perhaps a hammer. It requires no special skill.

In assembling the desk 20, the side sections 24 and 26 can be telescoped into the cross tubes 44 and 52 to produce the press-fitted permanent joints 39 illustrated in FIG. 9. Next, the top straight tubes 60 can be installed with their long ends 64 extending in a common direction, using screws 62. The curved support tubes 70 are installed by telescoping their ends into the long ends 64 of the top straight tubes 60, forming the joints 39. Either before or following the last described step, the curved support tubes 70 and 72 can be installed in the cross tube 78, forming press-fitted joints 39.

The top 86 is prepared for installation by tapping the fittings 92 into preformed recesses in the top sections 88 and 90. The top section 88 is first installed by driving screws 94 upwardly through the top straight tubes 60. Next, the dowels 96 are fitted into preformed recesses in the top section 88. A hammer may be used to tap them in place if necessary. The other top section 90 is fed onto the dowels 96 and is installed by driving screws 94 upwardly through the long ends 64 and through the curved support tubes 70 and 72.

It may be noted that the screws 94 are on opposite sides of the joints 39 formed between the long ends 64 and the curved support tubes 70 and 72 thereby locking the joint 39.

The file folder and basket frame 22 can be assembled by placing the top section 124 upside-down on a floor or table and installing the side sections 110 and 112, forming the joints 39. Next, the cross tubes 100 and 102 can be installed, forming additional joints 39. With these simple steps, the frame 22 is assembled.

The user can now select whether to use a file holder frame 138 or a basket 164 in either upper or lower positions of the desk 20 and of the file folder and basket frame 22. Either can be slid through and between selected pairs of the channel runners 32, 34 or 36 of the desk 20 and 132, 118 and 120 of the file folder and basket frame assembly 22. The file holder frame 138 is installed by sliding it between a selected pair of channel runners, such as the channel runners 32 of the desk 20.

The basket 164 is installed between a selected pair of channel runners, such as the channel runners 120 of the file folder and basket frame 22, and the stop 154 is snapped in place between a selected pair of the vertical wires 172, depending upon how far forward the user desires the basket 164 be permitted to slide.

File folders F are hung by their tabs T from the longitudinal channel runners 148 and 150 as is well known in the art. When it is desired to have access to one or more of the file folders F, the file folder frame 138 can be slid forwardly. If slid far enough, the stops 154 will engage the front vertical tubes, such as the tubes 28 of the desk 20, and prevent inadvertent removal of the file folder frame 138. Upon removal of one or more file folders F, the file folder frame 138 can be slid rearwardly to return it to its normal condition.

Likewise, to gain access to the basket 164, it is slid forwardly. The stop 154 will contact a vertical tube, such as the tube 114, and prevent inadvertent removal of the basket 164. When not in use, the basket 164 can be returned rearwardly to its normal position.

There are various changes and modifications which may be made to the invention as would be apparent to those skilled in the art. However, these changes or modifications are included in the teaching of the disclosure, and it is intended that the invention be limited only by the scope of the claims appended hereto.

What is claimed is:

1. A modular office furniture system comprising a desk having a front and rear and having first and second side assemblies, the first side assembly comprising front and rear vertical tube sections each having a top and a bottom, the front vertical tube sections being connected to the rear vertical tube sections by vertically spaced upper and lower pairs of horizontally opposed channel runners, front and rear cross tubes each having a horizontal section for resting on a floor and having upstanding leg sections contiguous with the horizontal section, the upstanding leg sections of the front and rear cross tubes being telescopingly joined to the bottoms of the front and rear vertical tube sections, respectively, a forward horizontal straight tube extending between the tops of the front vertical tube sections, a rearward horizontal straight tube extending between the tops of the vertical tubes, the tops of the vertical tube sections being flattened to permit them to lie against the horizontal straight tubes at their points of contact, and screws connecting the flattened upper ends of the vertical tube sections to the horizontal straight tubes, a forward curved support tube having a horizontal section telescopingly fitted to the forward horizontal straight tube, a rearward curved support tube having a horizontal section telescopingly fitted to the rearward horizontal straight tube, the forward and rearward curved support tubes having forward and rearward vertical sections, respectively, a cross tube having a front to rear extending horizontal section for resting on a floor and having upwardly extending front and rear legs, the front leg of the cross tube being telescopingly fitted to the forward vertical section of the forward curved support tube and the rearward leg of the cross tube being telescopingly fitted to the rearward vertical section of the rearward curved support tube, a desk top, and screw fasteners connecting the desk top to the horizontal straight tubes and the horizontal sections of the curved support tubes, a file holder frame having side members adapted to slidingly fit within a selected pair of the horizontally opposed channel runners and being adapted to support a plurality of file folders, a basket having side members spaced and adapted to fit between a selected pair of horizontally opposed channel runners, a contact element on the file folder frame, a contact element on the basket, a stop installed on at least one of the upper channel runners and a stop installed on at least one of the lower channel runners for sliding movement thereon, each stop having a portion positioned to be contacted by the contact element of the file folder frame or the contact element of the basket and having another portion adapted to contact a vertical tube section at the front of the desk during sliding movement of either the file folder frame or the basket.

2. The modular office furniture system of claim 1 including a file folder and basket frame assembly comprising two upright assemblies, each upright assembly comprising vertical front and rear tube sections, at least one pair of channel runners, the channel runners extending front to rear and being connected to the front tube sections, respectively, and to the rear tube sections, respectively, a top assembly comprising front and rear cross tubes, each cross tube having a horizontal tube section and vertical side legs extending downwardly from the ends of the horizontal tube section, the front section vertical side legs being telescopingly fitted with the front vertical tube sections and the rear section side legs being telescopingly fitted with the rear vertical tube sections, a channel runner extending between one front and one rear side leg and another channel runner extending between the other front and the other rear side leg, front and rear cross tubes each comprising a horizontal base section and upstanding leg sections, the front cross tube leg sections being telescopingly fitted to the front vertical tube sections and the rear cross tube leg sections being telescopingly fitted to the rear vertical tube sections, the file holder frame and the basket being selectively installable on selected pairs of the channel runners of the file folder and basket frame assembly.

3. The modular office furniture system of claim 2 including additional stops for installation on selected ones of the channel runners of the file folder and basket frame assembly.

4. The modular office furniture system of claim 2 wherein each file holder frame supports parallel channel runners extending front to rear and opening upwardly to receive side tabs of a plurality of file folders.

5. The modular office furniture system of claim 1 wherein the desk top comprises two rectangular sections, and dowels for locating adjacent side edges of the desk top sections relative to one another.

6. A modular office furniture system comprising a desk having a front and rear and having first and second side assemblies, the first side assembly comprising front and rear vertical tube sections each having a top and a bottom, the front vertical tube sections being connected to the rear vertical tube sections by vertically spaced upper and lower pairs of horizontally opposed channel runners, front and rear cross tubes each having a horizontal section for resting on a floor and having upstanding leg sections contiguous with the horizontal section, the upstanding leg sections of the front and rear cross tubes being telescopingly joined to the bottoms of the front and rear vertical tube sections, respectively, a forward horizontal straight tube extending between and connected to the tops of the front vertical tube sections, a rearward horizontal straight tube extending between and connected to the tops of the rear vertical tubes, a forward curved support tube having a horizontal section telescopingly fitted to the forward horizontal straight tube, a rearward curved support tube having a horizontal section telescopingly fitted to the rearward horizontal straight tube, the forward and rearward curved support tubes having forward and rearward vertical sections, respectively, a cross tube having a front to rear extending horizontal section for resting on a floor and having upwardly extending front and rear legs, the front leg of the cross tube being telescopingly fitted to the forward vertical section of the forward curved support tube and the rearward leg of the cross tube being telescopingly fitted to the rearward vertical section of the rearward curved support tube, a desk top, and means connecting the desk top to the horizontal straight tubes and the horizontal sections of the curved support tubes, a file holder frame having side members adapted to slidingly fit within a selected pair of the horizontally opposed channel runners and being adapted to support a plurality of file folders, and a basket having side members spaced and adapted to fit between a selected pair of horizontally opposed channel runners.

* * * * *